US006050533A

United States Patent [19]

Cruz

[11] Patent Number: 6,050,533

[45] Date of Patent: Apr. 18, 2000

[54] COMPONENTS TO STABILIZE LADDERS AND CREATE LOCALIZE SCAFFOLDS

[76] Inventor: Felix Cruz, 25 Martin St., Paterson, N.J. 07501

[21] Appl. No.: 08/699,010

[22] Filed: Aug. 30, 1996

[51] Int. Cl.[7] ..... E04G 5/06

[52] U.S. Cl. ..... 248/231.71; 248/208; 248/210

[58] Field of Search ..... 248/208, 210, 248/231.71, 226.11; 182/206, 196

[56] References Cited

U.S. PATENT DOCUMENTS

| | | | |
|---|---|---|---|
| 2,935,284 | 5/1960 | Reeves | 248/208 |
| 3,394,910 | 7/1968 | Ulich | 248/208 |
| 4,580,660 | 4/1986 | Oling | 248/210 X |
| 4,823,912 | 4/1989 | Gould et al. | 248/210 X |
| 5,117,941 | 6/1992 | Gruber | 248/210 X |
| 5,326,059 | 7/1994 | Pryor et al. | 248/231.71 |
| 5,368,262 | 11/1994 | Garrity | 248/208 X |

*Primary Examiner*—Peter M. Cuomo
*Assistant Examiner*—Stephen Vu

[57] ABSTRACT

A main structural component (the unit) is disclosed herein which includes having on its front surface two center openings and two clamp like mechanisms, one permanent restraining block and two unique adjustable blocks. The adjustable blocks' length of travel shall be the same as the length of the slotted opening transversing from the unit's front surface to the back. The unit shall be utilized in conjunction with the multiple and distinct set of sub-components described herein. The unit's functionality is manifested when the sub-components are attached to its center, and the complete assembly (unit and sub-components) is installed on top of the inner ledge molding (the stool) of any window. The ultimate object is to simplify the process of stabilizing ladders and assembling localize scaffolds. The unit when used properly, shall completely balance the lateral, vertical, and outward horizontal forces created when an individual is using a ladder or scaffold.

3 Claims, 4 Drawing Sheets

COMPONENTS TO STABILIZE LADDERS AND CREATE LOCALIZE SCAFFOLDS

BACKGROUND OF THE INVENTION

1. Field of the Invention

This invention's functionality primarily lies in the area of equipment and/or system concerned with creating construction scaffolds or preventing ladders from tilting over while they are being used.

2. Description of the Prior Art

The existing equipment or components to stabilize ladders do not adequately counter balance and restrain the lateral, outward horizontal, and downward vertical forces created when an individual is working and resting on a ladder's steps. In addition, most of the equipment available require portions of a building or house's external structure to be angled correctly or to protrude outward from the main surface in order for the equipment to latch on or attach itself to the protruding surface. Furthermore, the equipment in cumbersome and takes a lengthy time to install.

With respect to the existing, scaffold equipments, the equipment falls into two types. Type I equipment is safe, cumbersome, lengthy to assemble, and very expensive. Type II equipment is relatively safe, cumbersome and lengthy to assemble, and still relatively expensive.

Type II equipment utilizes over 20 feet tall poles, brackets "A" to attach poles to the roof structure, and brackets "B" attach to the poles. A wooden plank in used and placed on top and across two separated bracket "B". This type of equipment is reasonably unstable because of the moments created by the extremely high poles, and the fact that the bottom, at ground level, of the poles are not fastened to any type of structural member or surface. Furthermore, because of the location of the point (at an extremely high elevation) there the poles are attached to the roof structures, the lateral, outward horizontal, and downward vertical forces created while individuals are working, utilizing this type of equipment, are not all canceled and can create a safety hazard.

SUMMARY OF THE INVENTION

The invention described herein, addressing the object of stabilizing ladders is simple to install, does not depend on the ladder's structural integrity nor on external protruding structural surfaces in order to counter balance the lateral, outward and downward forces created when an individual uses a ladder.

With Respect to scaffolds, this invention has the advantage that it requires very little time and is easy to assemble, and shall be less expensive than type I or II scaffolds. Furthermore, this novel invention shall be more than type II and comparable to type I in providing safety to the users. In addition, the utilization of this novel invention shall not require the user to imbed large fasteners into the exterior roof or other exterior surfaces.

The invention described herein utilizes an extremely small amount of material compare to type I or II equipment in order to utilize the invention for its intended purpose. In addition, one of the sub-components shall allow the erection of poles in a much safer manner then type II equipment permits and this can be done without creating openings for fasteners in the roof or other surfaces of the building or house.

DESCRIPTION OF THE PREFERRED EMBODIMENT(S)

Figure 1A:
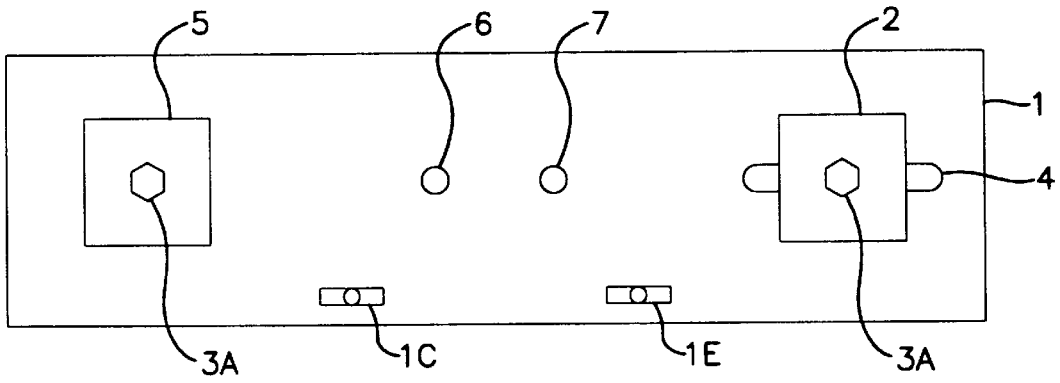
FIG. 1 shows a front elevation view of the main component.

Referring now to FIG. 1 through 9, there is shown a main structural component 1 (that shall be referred from here on in as the unit) with an adjustable restraining block 2 placed in the middle of an oval shaped slotted opening 4, and one restraining block 5. There is also shown two clamp like mechanisms in the front bottom surface of the unit which consists of two handles and clamp plate 1A and 1B and 1C and 1E respectively. The unit 1 has four unique sub-components that each attach to the unit by inserting the sub-components' embedded bolts through the two center openings 6 and 7. These sub-components are shown in FIGS. 5, 6, 8, and 9. Also, shown is the external sub-component FIG. 7 that shall be used in combination with sub-component FIG. 5 or 6, and the second adjustable "Clamp-Block" 8 FIG. 4.

Although, the unit 1 is shown with only two center openings it can have as many openings as needed. The number of openings shall be determined by the type or amount of sub-components being attached to the unit. Furthermore, the areas, on the surface, of the unit, FIG. 1, or sub-components whereby ropes, straps, poles, or wooden planks are located shall be refer to as the point of attachment, and the width of the surface areas to the left of block 5 and to the right of block 2, FIG. 1 and 2 and referred to from here on in as the unit's left and right wings respectively, shall each be larger than the width of a window's inside side casing.

Figure 2:
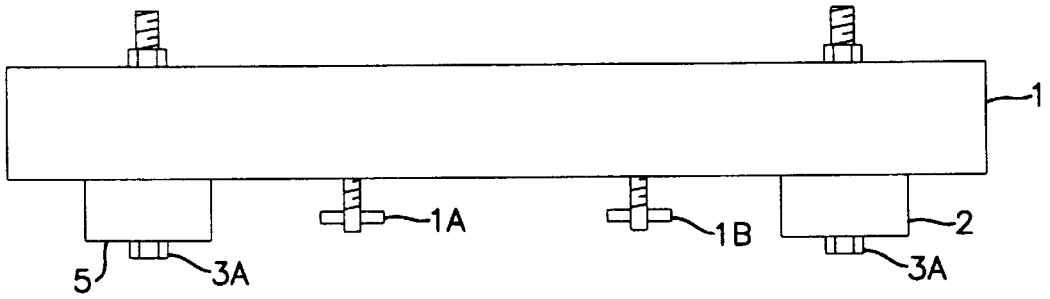
FIG. 2 shows a top view of the main component (the unit).
Figure 3:
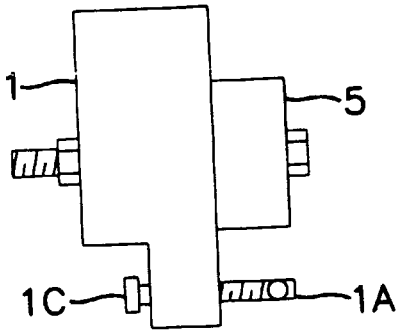
FIG. 3 shows a left side view of the unit and one front clamp.

I shall now refer to FIG. 1 and FIG. 2 in order to best described how this novel invention can be utilized. The unit is used by placing it on top of the stool of any window, with blocks 2 and 5 facing out toward the outside of the window, and front clamp plate 1C and 1E fully retracted outward away from the window's stool. The clamp plates 1C and 1E are retracted by rotating handle 1A and 1B counter clockwise. Then, Block 5 is press against the left vertical side of a windows' inside side casing, and block 2 is then adjusted, horizontally, to the proper window's width, and press firmly against the right vertical side of the window's inside casing. To finally secure the unit, tighten nut 3A to prevent block 2 from moving, rotate handles 1A and 1B clockwise until the clamp plates 1C and 1E are pressing firmly against the back of the window's stool, and make sure that the unit's left and right wings extend beyond the width of the window's inside side casings.

With the unit firmly secured against the window frame any of the sub-components can be attached by inserting the imbedded bolts 10E and 10F or 11E and 11F or 13E and 13F or 14F and 14G through the center openings 6 and 7 and locking them behind the front surface of the unit with the appropriate locking nuts.

Figure 5:
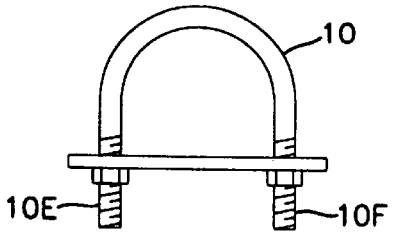
FIG. 5 shows a side view of the "U-Bolt" sub-component.
Figure 6A:
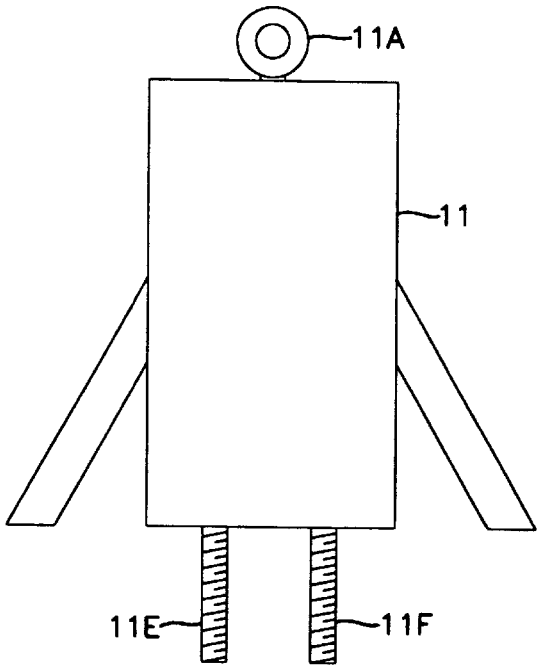
FIG. 6 shows a top view of the "Strap" sub-component.
Figure 7:
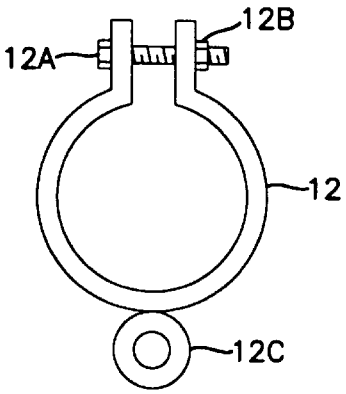
FIG. 7 shows a aide view of the "Ring" sub-component.

The following describes the functionality of the unit when it is utilized with either sub-component "U-Bolt" FIG. 5 or "Strap" FIG. 6 and the external "Ring" sub-component FIG. 7. The major-hub 12 is placed around one of the ladder's steps and secure by installing bolt 12A through the major-hub's bolt opening and tightening nut 12B. A ladder is raised and placed in front of a window where a unit 1 and sub-component have already been installed. At this time, one end of a correctly strengthen rope or straps with hooks can be tied to the corresponding sub-component's point of attachment 10 or 11A. The other end of the rope can now be tied to the minor-hub 12C. The rope or strap are slowly tighten until there is no slack and the ladder's usual unstable movements have been eliminated.

The unit can also be utilized to stabilize ladders placed between two windows. In this case, two units and the appropriate sub-component are installed at similar elevations on two different windows and then each sub-component is fastened, as described above, to the ladder at a similar elevation.

Figure 9A:
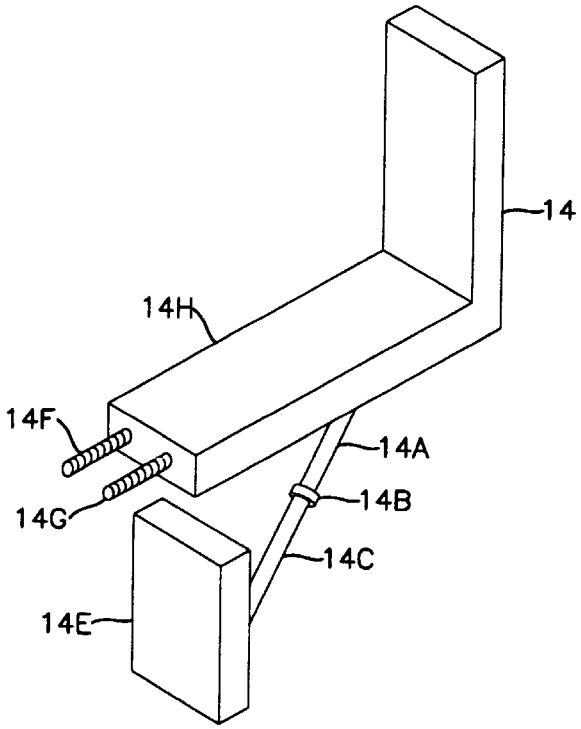
FIG. 9 shows a perspective of the "L-Plank" sub-component.

The following describes the functionality of unit, 1 when it is utilized with "L-Plank" sub-component FIG. 9. Once again the unit is secured to any window frame with the restraining blocks facing out, and the front clamps tightened against the back surface of the window's stool. Prior to installing FIG. 9 the bottom support leg 14C, is rotated counter clockwise and threaded into the top support leg 14A until it is a few inches away from junction point 14B. Then, bolts 14F and 14G are inserted through the center openings 6 and 7 and locked behind the unit with the appropriate locking nuts. A vertical body section 14 connects with a horizontal component 14H to form the L-shaped plank.

The bottom support leg 14C is now rotated clockwise until the rubber pad 14E is compressed and presses firmly against the exterior surface of the house or building.

The above actions are repeated on another window that is at the same elevation as the window having the first unit installed. Then, a continuous length plank board is placed on top of and between the two L-plank horizontal components 14H.

Figure 8A:
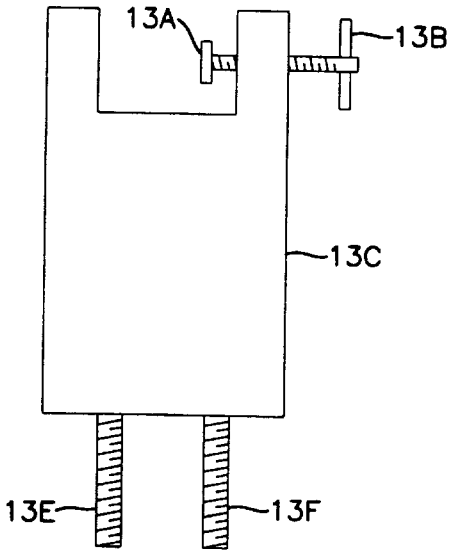
FIG. 8 shows a top view of "Pole-Clamp" sub-components.

The following describes the functionality of unit 1 when it is utilized with "Pole-Clamp" sub-component FIG. 8. Once again the unit is secured to any window frame as described herein. The embedded bolts 13E and 13F are inserted through the canter openings 6 and 7 and locked behind the unit with the appropriate locking nuts. Wooden poles, similar to those used in type II scaffolds, can now be inserted within the vice grip area of the minor component 13C. Then, handle 13B is rotated clockwise until clamping plate 13A is pressing tightly against the wooden poles.

Figure 4:
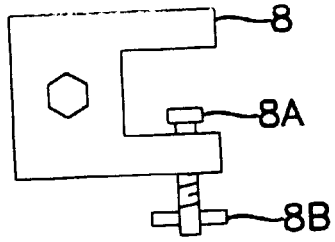
FIG. 4 shows a top view of the adjustable "Clamp-Block".

The unit 1 can be utilized, depending on the application, with either the regular adjustable block 2 FIG. 1 or the "Clamp Block" FIG. 4. The following describes the functionality of the unit 1 when it is utilize with block 8; block 8 is placed in the position where block 2 is placed on the unit 1, see FIG. 1 and 2. The unit, with Clamp-Block 8 installed is now placed on top of a window stool, as described herein, and "Clamp-Block 8 is placed so that the left side stop lies within the vice grip opening of clamp block 8. Then, handle 8B is rotated clockwise until the face plate 8A is pressing firmly against the side stop.

Although, I have only described one manner by which to attached the sub-components there exist many common and different ways to securely attach the sub-components to the center of unit 1. Also, Eye-Bolt and U-bolt mechanism 11A and 10 respectively can be located in different areas on the sub-component FIG. 6 and the surface of the unit 1 respectively. In addition, Eye-Bolt 11A positioned on rectangular body section 11E and U-Bolt 10 can be substituted for each other as the need arises.

The uniqueness of this invention is best illustrated by the versatility of the sub-components which can allow minor components of a primary sub-component to rotate. This is best shown in FIG. 8, where it is obvious that this sub-components functionality is enhanced by having the top portion 13C (the minor component) rotate at different angles from 13 the primary component.

Even though only one embodiment has been presented and given special emphasis, this does not imply that all useful usage of this unique invention have been described. For example: with minor modification the unit can be made to attach itself to structural framing beside window framing; and, the vertical member of the "L-Plank" sub-component can be lengthened and widened in order to install restraining nets between two plank supports. In general, the physical dimensions of the sub-components can be altered to allow the utilization of the invention at different plane and angles other than at 90 or 180 degrees. In addition, the main component and sub-components can be manufactured in a monolithic manner thereby eliminating the need for most bolts and fasteners.

I claim:

1. A main structural component having a plank shape adapted to secure to vertical structural members on a window, said main component comprising:

a front surface, two centrally located bores, wherein each of said bores projects inwardly through a back surface of the component to the front surface, a horizontal slotted opening right of said centrally located bores, a permanently attached retraining block positioned left of said centrally located bores, one longitudinal adjustable rectangular block positioned on top of said slotted opening having one embedded threaded rod projecting outwardly from the back surface and through said slotted opening, and whereby a wing nut is threaded onto said threaded rod to fasten the adjustable block to the back surface of the main component; and a sub-component having a pair of embedded rods inserted into the two central bores on the front surface of the main component with a pair of wing nuts fastened to the respective pair of rods on the back surface of the main component to enable the sub-component to be physically attached to the main component.

2. The main structural component according to claim 1, wherein the sub-component is a rectangular shaped body section comprising a front surface having an eye-bolt attachment, a pair of side surfaces each having a lateral support arm projecting outwardly at a 45 degree angle, and a back surface having the pair of embedded thread rods protruding outwardly.

3. The main structural component according to claim 1, wherein the sub-component is a rectangular shaped body section comprising a front surface having a clamping mechanism with left and right arms forming a substantially U-shaped profile, wherein a threaded rod extends through a bore on the right arm and engages with a clamping plate.

* * * * *